United States Patent [19]

Gundlach

[11] 4,110,024

[45] Aug. 29, 1978

[54] TRANSFER ASSEMBLY FOR ELECTROSTATIC TRANSFER OF A TONER IMAGE FROM A CURVILINEAR RECORDING SURFACE

[75] Inventor: Robert W. Gundlach, Victor, N.Y.

[73] Assignee: Xerox Corporation, Stamford, Conn.

[21] Appl. No.: 686,353

[22] Filed: May 14, 1976

[51] Int. Cl.[2] ..... G03G 15/00

[52] U.S. Cl. ..... 355/3 TR; 101/DIG. 13

[58] Field of Search ..... 355/3 TR, 3 R, 3 BE, 355/16, 3 FU, 3 DR; 101/DIG. 13

[56] References Cited

U.S. PATENT DOCUMENTS

| | | | |
|---|---|---|---|
| 3,332,328 | 7/1967 | Roth | 355/3 R |
| 3,521,950 | 7/1970 | Gardner et al. | 355/3 BE |
| 3,620,617 | 11/1971 | Kelly et al. | 355/3 R |
| 3,647,292 | 3/1972 | Weikel | 355/3 TR |
| 3,697,170 | 10/1972 | Bhagat et al. | 355/16 X |
| 3,910,697 | 10/1975 | Lanker | 355/3 R X |
| 4,023,894 | 5/1977 | Goel | 355/3 R |
| 4,025,182 | 5/1977 | Goel | 355/4 |

*Primary Examiner*—Richard L. Moses

[57] ABSTRACT

Transfer assembly for electrostatic transfer of an electrostatically adherent toner image from a curvilinear surface of an electrostatographic copier. This transfer device comprises, in combination, a web of corona pervious material and a corona discharge electrode. The corona pervious web is preferably in the form of an endless belt and comprises at least 30% voids in order to insure substantially uniform charging of the receiving sheet by applying transfer charges through a corona pervious web holding the sheet against the curvilinear surface by the corona discharge electrode associated with said web.

8 Claims, 6 Drawing Figures

TRANSFER ASSEMBLY FOR ELECTROSTATIC TRANSFER OF A TONER IMAGE FROM A CURVILINEAR RECORDING SURFACE

BACKGROUND OF THE INVENTION

1. Field of the Invention

This invention is directed to an apparatus and a method of use of such apparatus. More specifically, this invention is concerned with apparatus capable of substantially complete transfer of an electrostatically adherent toner image from a curvilinear surface to an electrostatically charged receiving sheet. The curvilinear surface can correspond to the image recording element or an intermediate transfer element of an electrostatographic copier.

2. Description of the Prior Art

The formation and development of images on the recording surface of electrostatographic copying equipment is well known. The best known of the commercial process, more commonly known as xerography, involves forming a latent electrostatic image on the imaging layer of an imaging member by first uniformly electrostatically charging the surface of the imaging layer in the dark and then exposing the electrostatically charged surface to a light and shadow image. The light struck areas of the imaging layer are thus rendered relatively conductive and electrostatic charge selectively dissipated in these irradiated areas. After this imaging member is exposed, the latent electrostatic image is rendered visible by development with electrostatically charged materials, commonly referred to in the art as "toners". This toner will be principally attracted to those areas of the image bearing surface which retain the electrostatic charge and thus form a visible toner image.

The developed image can then be read or permanently affixed to the imaging layer in the event the imaging layer is not to be reused. This latter practice is usually followed with respect to the binder type photoconductive films (e.g., zinc oxide dispersed in a film forming insulating resin) where the photoconductive insulating layer of the imaging member is also an integral part of the finished copy. In so-called "plain paper" copying systems, the latent image can be developed on the imaging surface of a reusable imaging member or transferred to another surface, such as a sheet of plain paper and thereafter developed. When the latent image is developed on the imaging surface of a reusable imaging member it is subsequently transferred to another substrate and then permanently affixed thereto. Any one of a variety of well known techniques can be used to permanently affix the toner image to the copy sheet, including overcoating with transparent films and solvent or thermal fusion of toner particles to the supportive substrate.

It is essential that during the transfer of the toner image from the surface of the imaging member to the receiving sheet, the receiving sheet remain in contact with the imaging member and be transported in registration therewith. Ordinarily, the receiving sheet is introduced into the above type of reproduction equipment in a manner consistent with the above noted requirements; however, the degree of conformance of the receiving sheet to the imaging member surface will vary depending upon the relative stiffness (flexibility) of materials from which the receiving sheet is formed and the relative thickness of the receiving sheet. As will be readily appreciated, the more arcuate (convex) the imaging surface of the recording element, the greater the difficulty encountered in securing conformance of the receiving sheet thereto. The prior art discloses various techniques for achieving conformance of the receiving sheet to a recording element in the region of electrostatic transfer of toner from the surface of a recording element to a receiving sheet; see for example conformance of a receiving sheet to a photoreceptor by the use of bands (U.S. Pat. No. 3,332,328, FIG. 3, Column 3, lines 52-70) or by means of a biased transfer roll (U.S. Pat. No. 3,702,482). Each of the systems described in the above referenced patents suffer from one or more deficiencies, resulting in the nonuniform transfer of toner particles from the imaging surface of the recording element to the receiving sheet. In the transfer system described in the U.S. Pat. No. 3,332,328 the relatively broad bands can shield the backside of the transfer sheet from corona emission, resulting in variation in the fields placed across the transfer sheet and thus the non-uniform transfer of toner from the recording element to the receiving sheet. The transfer system disclosed in the U.S. Pat. No. 3,702,482 is similarly deficient in that it is highly humidity sensitive. Experience has shown that in moist environments the transfer roller will not satisfactorily affect transfer of the toner image from the recording element to the transfer sheet.

Accordingly, it is the object of this invention to remedy the above as well as related deficiencies in the prior art.

More specifically, it is the primary object of this invention to provide apparatus which will permit the substantially uniform transfer of an electrostatically adherent toner image to a receiving sheet from a toner bearing surface of an electrostatographic copier.

It is another object of this invention to provide apparatus which is capable of effecting substantially uniform transfer of an electrostatically adherent toner image to a relatively inflexible receiving sheet from a photosensitive recording element of an electrostatic copier.

It is yet another object of this invention to provide apparatus suitable for the electrostatic transfer of electrostatically adherent toner particles to a relatively inflexible receiving sheet from the photosensitive element of an electrostatographic copier in a manner which is intended to minimize abrasive contact with the imaging surface of the photosensitive element of said copier.

Still yet another object of this invention is to provide apparatus wherein the transfer assembly is combined with additional means capable of vacuum assisted stripping of the receiving sheet from an image bearing surface subsequent to toner transfer to the receiving sheet.

Additional objects of this invention include the combination of the transfer apparatus of this invention with other components of electrostatographic copying equipment and the use of such combinations in electrostatographic recording methods.

SUMMARY OF THE INVENTION

The above and related objects of this invention are achieved by providing an apparatus for the electrostatic transfer of an electrostatically adherent toner image from a curvilinear surface of an electrostatographic copier. This apparatus comprises a plurality of rollers arranged axially parallel to one another, a continuous web of corona pervious material supported on at least two of the axially parallel rollers and at least one corona discharge electrode positioned relative to the corona pervious web so as to permit the electrostatic tacking of the electrostatically adherent toner image from the curvilinear surface to a receiving sheet as said receiving sheet is transported by the curvilinear surface through the region of contact of the web and the curvilinear surface. The continuous web which is supported on the axially parallel rollers comprises materials having a bulk resistivity of at least $10^6$ ohm-cm and has a porosity of at least 30 and preferably greater than 50%. This apparatus also includes means for advancement of the corona pervious web in registration with the movement of the curvilinear surface and means for activation of the corona discharge electrode in registration with the passage of the receiving sheet through the region of contact of the web and the curvilinear surface.

In the preferred embodiments of this invention, the web of corona pervious materials is equipped with edge guides which correspond to channels in the axially parallel rollers thus preventing lateral creep of the web as it passes over these rollers.

DESCRIPTION OF THE INVENTION INCLUDING PREFERRED EMBODIMENTS

Figure 1:
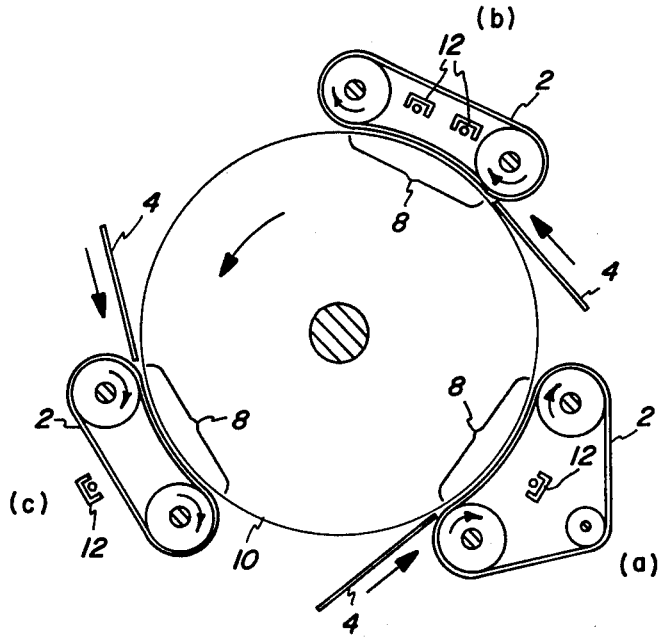
FIG. 1 is illustrative of three representative embodiments of the transfer assembly of this invention when used in conjunction with a drum type photoreceptor.

In FIG. 1 are shown three representative embodiments of the transfer assembly of this invention when used in conjunction with a curvilinear surface in the form of a photoconductive drum. It is understood that each of assemblies *a*, *b* and *c* are used in conjunction with other stations of an electrostatographic copier and that such copier will traditionally have only one such transfer assembly. As illustrated in FIG. 1 assemblies *a* and *b* differ from assembly *c* in that the corona discharge electrode 12 which effects electrostatic transfer of the electrostatically adherent toner from the curvilinear surface 10 to the receiving sheet 4 are separated from said receiving sheet by only one layer of the corona pervious web 2. As the corona pervious webs 2*a*, 2*b*, and 2*c* are moved in registration with the curvilinear surface 10 by a transport means (not shown) which can typically include a drive mechanism operating on one of the rollers supporting the corona pervious web materials, a receiving sheet 4 is introduced into the transfer zone 8 coincident with movement of the toner image (not shown) on the surface of the photoconductive drum. The receiving sheet can be a continuous insulating paper web or cut sheets of paper. Concurrent with or subsequent to the passage of the leading edge of the receiving sheet into the transfer zone, the corona discharge electrode 12 (or electrodes) of the transfer assembly are energized. The polarity of the bias and the magnitude of the potential applied to these electrodes is sufficient to impart a substantially uniform charge to the backside of the receiving sheet, thereby causing electrostatic detacking of substantially all of the toner image from the curvilinear surface of the photoreceptor and its electrostatic transfer to the surface of the receiving sheet then in contact therewith. The corona pervious web insures substantially continuous contact of the receiving sheet with the curvilinear surface in the transfer zone. As the leading edge of the receiving sheet exits the transfer zone the electrostatic forces operating on this sheet may result in its adherence to the curvilinear surface. This is generally not a problem where the receiving sheet is a relatively inflexible paper stock and thus upon exiting the transfer zone it will effectively strip itself from the curvilinear surface. Where the receiving sheet is not self-stripping, any expedient known in the art can be used to effect displacement of the receiving sheet from the curvilinear surface provided such displacement does not disturb the toner image which is electrostatically adherent to the receiving sheet or damage the curvilinear surface. A particular advantage of the transfer assembly of this invention is its compatibility with means for vacuum assisted stripping (Ref. numeral 74 of FIGS. 5 & 6) of the receiving sheet from the toner image bearing surface. The efficiency of such vacuum stripping systems markedly improves as the vacuum head (Ref. numeral 75 of FIGS. 5 & 6) is brought closer to the receiving sheet. The presence of the corona pervious web 2 intermediate between the vacuum head of the stripping means and the receiving sheet reduces the likelihood of snagging the lead edge of the transfer sheet on the vacuum head and this is generally not a problem even when the vacuum head is close enough to the receiving sheet to be in contact with the corona pervious web. Subsequent to stripping of the receiving sheet from the curvilinear surface, the toner image is permanently affixed to said sheet by any one of a variety of well known techniques; such as solvent or thermal fusion or overcoating with transparent films.

Figure 2:
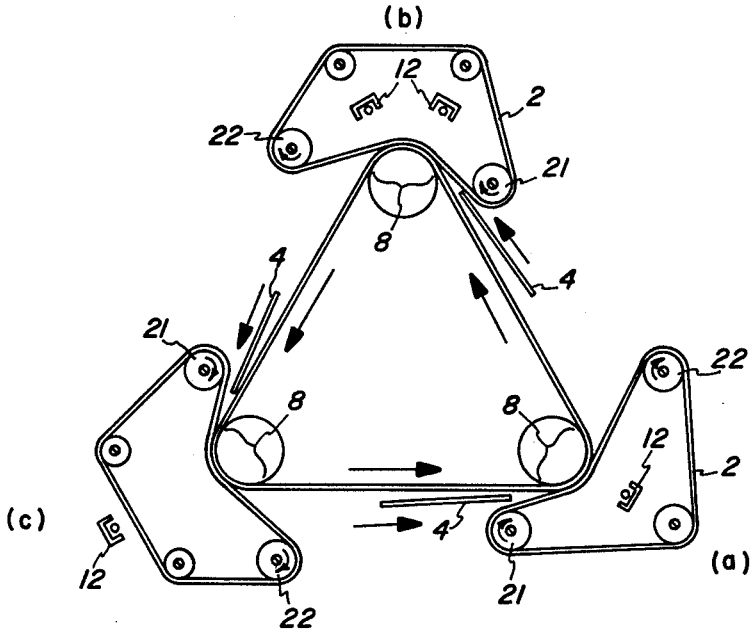
FIG. 2 is illustrative of three representative embodiments of this invention used in conjunction with a flexible belt type photoreceptor.

FIG. 2 is another embodiment of this invention wherein the transfer assembly is used in conjunction with a flexible photoconductor belt. The transfer assembly is associated with the flexible photoconductive web in essentially the same manner as described in FIG. 1, except that the transfer zone is substantially more arcuate thus increasing the tendency of the transfer sheet to prematurely separate from the curvilinear surface in advance of completion of transfer of the toner image. The transfer assembly prevents this premature separation. Roller 21 at the entrance to the transfer zone of the transfer assembly is preferably located closer to the photoconductive web than the roller 22 at exit of transfer zone of the assembly. This asymmetrical arrangement enables modulation of the area of the transfer zone and takes full advantage of the self-stripping tendency of the transfer sheet once the toner is electrostatically adherent thereto.

Figure 3:
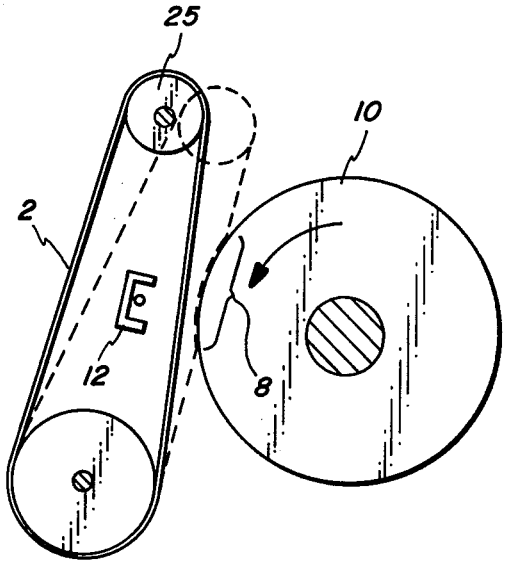
FIG. 3 is illustrative of a preferred transfer assembly of this invention wherein the transfer assembly is only periodically contacted with the curvilinear surface from which the toner image is to be transferred.
Figure 4:
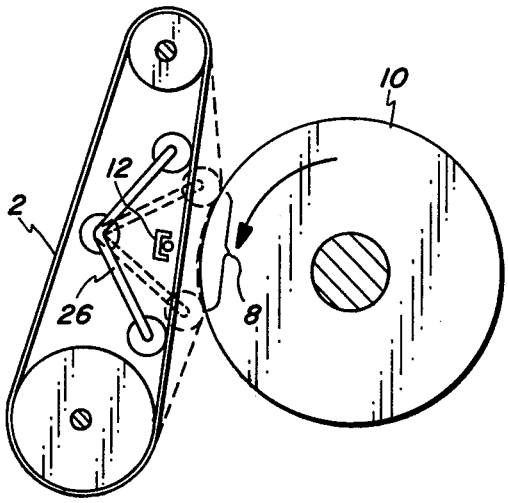
FIG. 4 is illustrative of another preferred embodiment of the transfer assembly wherein the transfer assembly is only periodically contacted with the curvilinear surface during the transfer of the electrostatically adherent toner image from the curvilinear surface.

In FIGS. 3 and 4, the transfer assembly is maintained at a location within the copier remote from the curvilinear photoconductive surface until such time as it is needed to effect transfer of the toner image. At the appropriate interval in the machine cycle, the machine logic will (a) cam the moveable support roller (Ref. numeral 25 of FIG. 3) or web deflection means (Ref.

numeral 26 of FIG. 4) so as to cause the corona pervious web of the transfer assembly to engage the curvilinear surface (b) inject a toner image receptive transfer sheet into the transfer zone and (c) energize the transfer corona electrode(s) of the transfer assembly. Subsequent to completion of its transfer function, the image receptive sheet will be ejected from the transfer zone, proceed to fusing station, and the moveable support roller and web deflection means of FIGS. 3 and 4 respectively allowed to return to their pretransfer positions, thereby disengaging the corona pervious web from the curvilinear surface.

Figure 5:
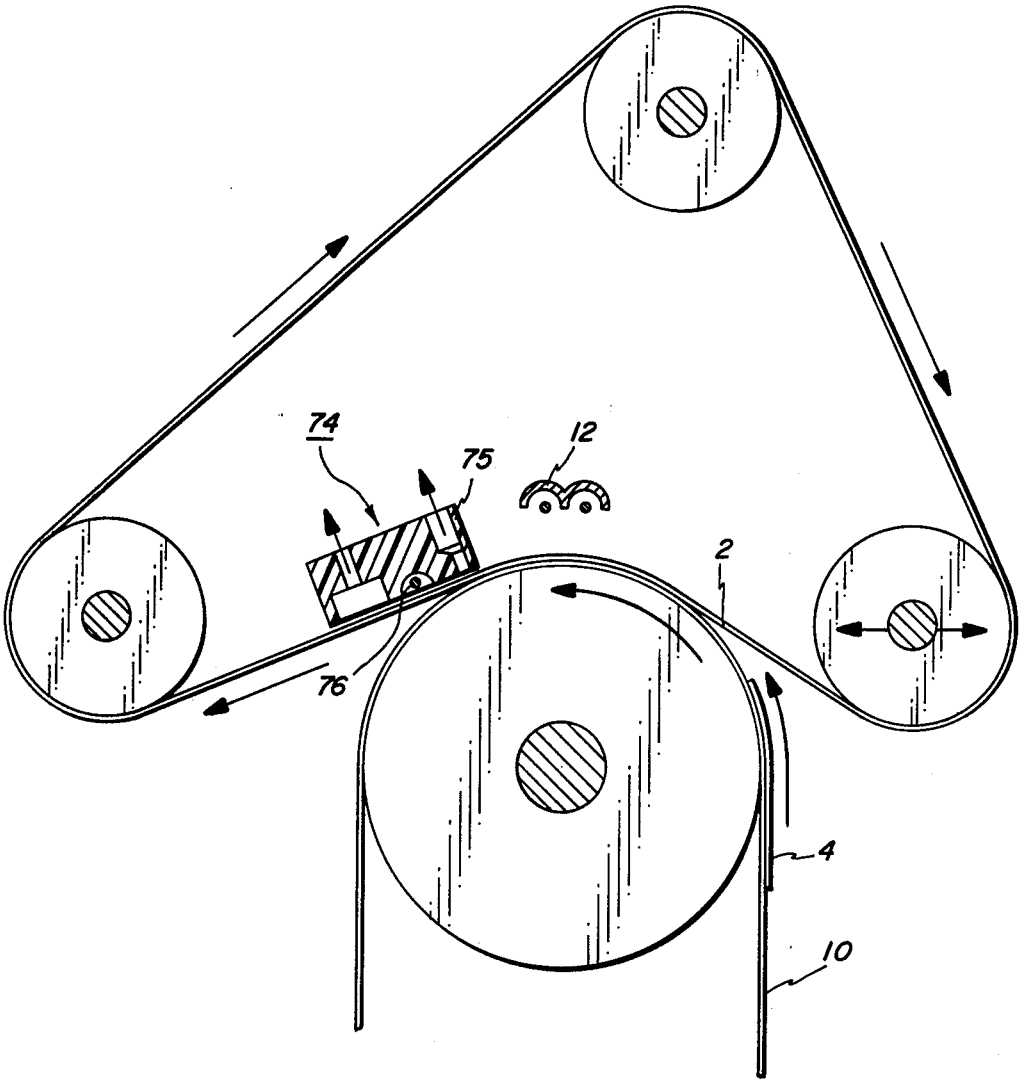
FIG. 5 is a modification of the transfer assembly shown in FIG. 2(*a*).
Figure 6:
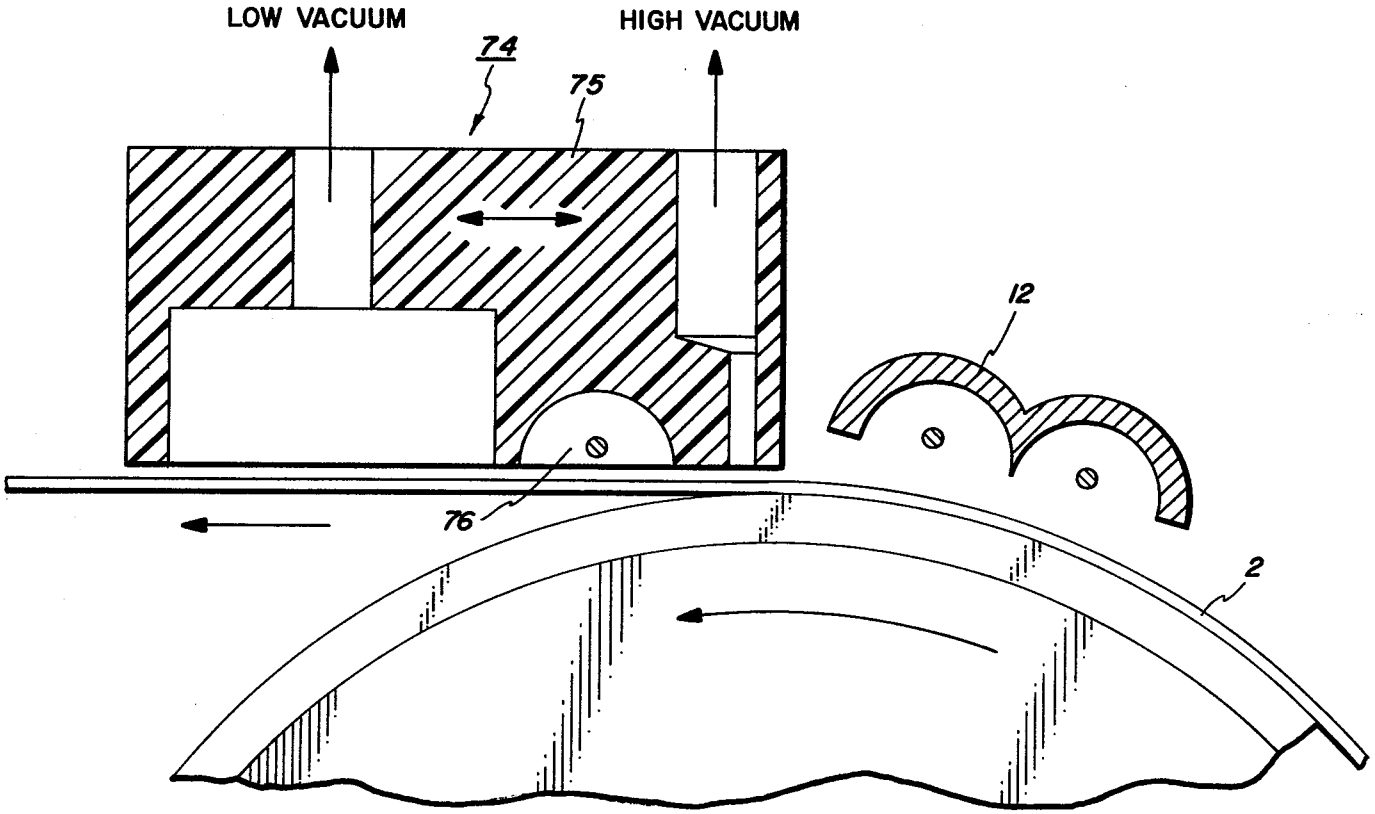
FIG. 6 is an enlarged view of the transfer zone of FIG. 5.

Other modifications of the above embodiments include the addition of vacuum means (Ref. numeral 74 of FIGS. 5 & 6) to assist in the stripping of image receptive sheet from the curvilinear surface and/or AC corona discharge means (Ref. numeral 76 of FIGS. 5 & 6).

The corona pervious webs of the transfer assemblies illustrated hereinabove can comprise virtually any material having a bulk resistivity of at least $10^6$ ohm-centimeters and sufficient void space to allow for the deposition of a substantially uniform blanket of charge to the backside of the toner image receptive transfer sheet. This corona pervious web can comprise a mesh of woven materials or comprise a perforated film. It is both critical and essential that the strand-like solid areas of the web have a filament diameter of less than about 10 mils (0.010 inches) and that the open areas of the web (that portion of the web devoid of solid filamentous material) be in excess of about 30 percent, and preferably in excess of 50 percent, of the area of the web. The materials from which the web is constructed can be virtually any organic material, inorganic material or mixture of organic and inorganic material. In order for the web to function most effectively, the finished web should preferably have a bulk resistivity of at least about $10^6$ ohm-cm or greater. Corona pervious web useful in the transfer assembly of this invention can be prepared from materials which are conductive or less resistive than specified hereinabove, and thereafter, treat the web or otherwise alter its insulating properties to bring it to within the preferred operational parameters of the preferred embodiments of this invention. In a typical transfer assembly of this invention, the corona pervious web can be constructed of any one of a number of synthetic polymeric fibrous materials such as nylon, Dacron polyester, and fiberglass reinforced synthetic yarns and fibers. The mesh produced from these fibrous materials can be in the form of a regular or random pattern. Corona pervious webs suitable for use in the transfer assemblies of this invention can also be prepared by perforation of a continuous thin film of polymeric material. The pattern of perforation must, of course, satisfy the previously stated requirements of the web with respect to percent void space and solid area dimensions which defines the voids of the web. The thickness of the web, irrespective of the mode of construction of the web, does not appear to be a factor with respect to applying a uniform charge to an image receiving sheet through the web. In the preferred embodiment of this invention, the web thickness will be of approximately the same dimension as the width of individual strands of the web (less than about 0.010 inches). Web construction and the materials from which the web is formed should provide sufficient mechanical integrity so as to avoid changes in its dimensional stability (i.e., stretching, fraying, etc.).

As indicated previously, the corona pervious web may also be prepared from materials generally regarded as substantially non-insulating, provided that the web is treated or coated with a material having the requisite resistivity. For example, fine aluminum wire screen can be treated with a polymeric sizing agent thereby rendering it sufficiently insulating to be suitable in the transfer assembly of this invention. Of course, the viscosity of the sizing solution should be carefully controlled so as to avoid clogging of the void space between the strands of the aluminum screen.

The determination of the operative parameters of this invention is based upon a series of tests conducted with various corona pervious webs in a testing fixture of the type illustrated in FIG. 5. The webs selected for this testing comprise a regular window screen-like mesh of monofilament polymeric fibers which are heat welded at their respective intersections.

This testing involves evaluation of completion of toner transfer by comparison of toner images which are transferred with the device of FIG. 5 and toner images substantially completely transferred by manual adhesive tape transfer techniques. According to this test procedure, a toner image is formed on the flexible photoreceptor 47 in the conventional fashion and then a portion of that image contacted with the adhesive surface of Scotch "Magic Mend" ® transparent tape. The tape is pressure contacted with the toner image in such a fashion as to effect total transfer of the underlying toner image. The tape is stripped from the photoreceptor surface and placed in pressure contact with a sheet of paper. The process of toner image formation is then repeated and image transfer accomplished by means of the device shown in FIG. 5. The receiving sheet bearing the toner image is retrieved manually prior to toner fusion and a piece of identical Scotch "Magic Mend" ® tape placed over that portion of the toner image corresponding to the area previously "fixed" by tape transfer techniques. Table I which follows indicates the wide range of web configurations suitable for use in this invention.

TABLE I

| WEB MATERIAL | MESH (Lines/Inch) | FILAMENT DIAMETER | RELATIVE OPEN AREA | BARE PLATE CURRENT* | PERFORMANCE |
|---|---|---|---|---|---|
| 1. None | — | — | 100 % | $2.0\times10^{-4}$amp | — |
| 2. Dacron | 300 | 0.001" | 36% | 1.8 | No clogging, wear, or tracking problems in laboratory operation |
| 3. Dacron | 200 | 0.001" | 46% | 1.8 | No problems |
| 4. Dacron | 175 | 0.001" | 52% | 1.8 | No problems |
| 5. Dacron | 110 | 0.002" | 48% | 1.8 | No problems |
| 6. Dacron | 100 | 0.0035" | 42% | 2.4 | No problems |
| 7. Dacron | 66 | 0.004" | 47% | 1.2 | No problems |
| 8. Dacron | 55 | 0.005" | 53% | 1.2 | No problems |
| 9. Dacron | 50 | 0.0065" | 47% | 1.2 | No problems |
| 10. Fiberglass | 14 | 0.013" | 67% | 1.4 | Creates "haze" on Se, shows "shadowing" |

TABLE I-continued

| WEB MATERIAL | MESH (Lines/Inch) | FILAMENT DIAMETER | RELATIVE OPEN AREA | BARE PLATE CURRENT* | PERFORMANCE |
|---|---|---|---|---|---|
| Window Screen | | | | | in transferred image at 10% R.H. |

*Base plate current is measured from corotron to grounded metal plate with corona current flow through the web material. No transfer sheet is present between the web and the plate during such measurement.

Table II which follows indicates the wide range of paper weights to which a toner image can be effectively transferred with the device of FIG. 5.

TABLE II

| PAPER WEIGHT | % R.H. | TRANSFER DENSITY RATIO (Electrostatic transfer density/ tape transfer density) |
|---|---|---|
| 12# Sub. | 8 | 0.94 |
| 120# Sub. | 8 | 0.945 |
| 20# Sub. | 8 | 0.963 |
| 20# Sub. | 25 | 0.942 |
| 20# Sub. | 40 | 0.946 |
| 20# Sub. | 55 | 0.940 |
| 20# Sub. | 70 | 0.946 |
| 20# Sub. | 85 | 0.952 |

It is highly noteworthy that such transfer is relatively insensitive to change in the moisture content of the ambient environment.

The specific embodiment of this invention set forth hereinbove are merely intended to be illustrative of this subject matter and should not be interpreted as delineating the scope of this invention which is set forth in the claims which follow.

What is claimed is:

1. In an electrostatographic copying system having means for forming a latent electrostatic image, means for development of said latent electrostatic image with electrostatically attractable developer material, and means for electrostatic transfer of the developed image of said developer materials from a curvilinear surface upon which the developed image is electrostatically adherent to a receiving sheet by applying transfer corona charges from a corona discharge device to the rear surface of the receiving sheet while the front surface of the receiving sheet is held in intimate engagement with said curvilinear surface over a transfer area thereof; the improvement comprising:

a highly corona pervious continuous web having a porosity of greater than 30%, the solid area of said web consisting of strand-like filamentous material in an open integral dimensionally stable open mesh configuration, said filamentous material having a filament diameter of about 10 mills or less and a bulk resistivity of at least $10^6$ ohm-cm to allow a substantially uniform application of said transfer corona charges through said corona pervious web, support means for arcuately deforming said corona pervious web over said transfer area of said curvilinear surface to hold a receiving sheet between said web and said transfer area of said curvilinear surface, means for moving said corona pervious web in registration with the movement of said curvilinear surface, and corona discharge means spaced from said curvilinear surface, with said corona pervious web interposed therebetween, for applying said transfer corona charges through the openings in said corona pervious web to the receiving sheet concurrently with the passage of the receiving sheet through the transfer area.

2. The electrostatographic copying system of claim 1, wherein said corona pervious web has open areas devoid of said filamentous material of greater than 50% of said web area.

3. The electrostatographic copying system of claim 1, wherein said corona pervious web is a screen made from crosswelded insulative fibers with more than 50% open areas.

4. The electrostatographic copying system of claim 1, wherein additional means are provided for engaging and disengaging the said corona pervious web from said curvilinear surface in coordination with said electrostatic transfer.

5. The electrostatographic copying system of claim 1, wherein said support mans comprises two spaced parallel axis rollers between which said corona pervious web is supported, and wherein said rollers are of different diameters.

6. The electrostatographic copying system of claim 1, wherein vacuum stripping means are positioned adjacent said corona pervious web for creating a partial vacuum through said web to assist in the stripping of a receiving sheet from said curvilinear surface toward said web subsequent to said transfer of the developed image to the receiving sheet.

7. The electrostatographic copying system of claim 6, wherein said vacuum stripping means further includes an AC corona generator means operative in combination therewith for stripping of the receiving sheet from said curvilinear surface.

8. The electrostatographic copying system of claim 1, wherein said corona pervious web has open areas devoid of said filamentous material of greater than 50% of said web area, and wherein vacuum stripping means are positioned adjacent said corona pervious web for creating a partial vacuum through said web to assist in the stripping of a receiving sheet from said curvilinear surface toward said web subsequent to said transfer of the developed image to the receiving sheet, and wherein said vacuum stripping means further includes a AC corona generator means operative in combination therewith for stripping of the receiving sheet from said curvilinear surface.

* * * * *